US009414672B1

(12) United States Patent
Flynn

(10) Patent No.: US 9,414,672 B1
(45) Date of Patent: Aug. 16, 2016

(54) ADJUSTABLE OVERHEAD STORAGE SYSTEM

(71) Applicant: Michael Flynn, Newport Beach, CA (US)

(72) Inventor: Michael Flynn, Newport Beach, CA (US)

( * ) Notice: Subject to any disclaimer, the term of this patent is extended or adjusted under 35 U.S.C. 154(b) by 10 days.

(21) Appl. No.: 14/642,757

(22) Filed: Mar. 10, 2015

(51) Int. Cl.
*A47B 81/00* (2006.01)
*A47B 96/06* (2006.01)

(52) U.S. Cl.
CPC ..... *A47B 81/00* (2013.01); *A47B 96/06* (2013.01)

(58) Field of Classification Search
CPC ..... A47B 81/00; A47B 96/06; A47B 53/00; A47B 53/02; A47B 46/00
USPC ..... 312/305, 321, 334.23–334.28, 198, 312/201, 140.3, 140.4, 205, 243, 245, 246, 312/248
See application file for complete search history.

(56) References Cited

U.S. PATENT DOCUMENTS 5,242,219 A * 9/1993 Tomaka ..... A47B 46/005 220/485
5,758,782 A * 6/1998 Rupert ..... A47B 46/00 211/104
8,056,988 B2 * 11/2011 Pan ..... A47B 53/00 312/201
8,622,488 B1 * 1/2014 Kilby ..... A47B 46/005 211/103
2007/0079735 A1 * 4/2007 Bobis ..... A47B 53/02 108/102
2007/0158286 A1 * 7/2007 Beurer ..... A47B 53/02 211/113
2009/0120321 A1 * 5/2009 Tourdot ..... A47B 53/02 104/139
2014/0346934 A1 * 11/2014 Flynn ..... A47B 53/02 312/202

* cited by examiner

*Primary Examiner* — Daniel Rohrhoff
(74) *Attorney, Agent, or Firm* — Ali Shalchi, Esq.

(57) ABSTRACT

An adjustable overhead storage system includes a main beam having a lower surface with a channel configured to receive a plurality of storage cabinets. The storage cabinets are slidably and reversibly engaged with the main beam via a rolling mechanism. The storage cabinets each have a pair of doors on a front side and a handle on an adjacent outer side. The storage cabinets are connected with the support beam in series such that the front of each storage cabinet faces the back of the adjacent storage cabinet. The storage cabinets are movable with respect to each other and the main beam. Based on the storage needs and available space, storage cabinets can be added or removed from the main beam. An alternate embodiment provides an elbow joint that joins the support beams and main beam, and contains an internal mechanism that allows storage cabinets to travel therebetween.

12 Claims, 10 Drawing Sheets

ADJUSTABLE OVERHEAD STORAGE SYSTEM

RELATED U.S. APPLICATION DATA

This application claims priority to Provisional Application No. 61/655,492, filed Jun. 5, 2012 and is a continuation-in-part of Non-Provisional patent application Ser. No. 13/901,973.

FIELD OF THE INVENTION

The present invention relates to storage cabinets, and in particular, modular or movable storage cabinets.

BACKGROUND OF THE INVENTION

Residential and commercial garages are commonly used for storage and workspaces. As space is always limited, there is always a desire to conserve space while maximizing the utility of the space. Often, the use of substantial amounts of space for storage precludes the availability of adequate space for workstations, car parking, or other uses. Conversely, the creation of workspaces (e.g. work benches) often comes at the cost of decreased storage space. Moreover, conventional storage systems (e.g. cabinets, closets, lockers) are often heavy and fixed, and do not make optimal use of space or provide versatility in movement or orientation. Thus, there is a need for a versatile and space-efficient storage system for use in garages, storage rooms and other settings.

SUMMARY OF THE INVENTION

An adjustable overhead storage system includes a main beam having a lower surface with a channel and an inner rail configured to reversibly receive a plurality of storage cabinets. The storage cabinets are slidably and reversibly engaged with the beam via a rolling mechanism that is connected with a top surface of each storage cabinet. The storage cabinets each have a pair of doors on a front side and a handle on an adjacent outer side. The storage cabinets are connected with the support beam in series such that the front of each storage cabinet faces the back of the adjacent storage cabinet. Each storage cabinet is movable with respect to each other storage cabinet and the main beam. In an alternate embodiment, an elbow joint is provide which connects the main beam to the support beams and houses a mechanism that allows the storage cabinets to travel between adjacent beams by receiving and rotating the rolling mechanism as it reaches and passes through the elbow joint. Based on the storage needs and available space, the storage cabinets can be added or removed from the beam as desired. The ability to stack or nest the cabinets together allow for more efficient use of space because more cabinets can be fit in a space when they are stacked front-to-back instead of side-by-side as is conventional.

DETAILED DESCRIPTION

Figure 1:
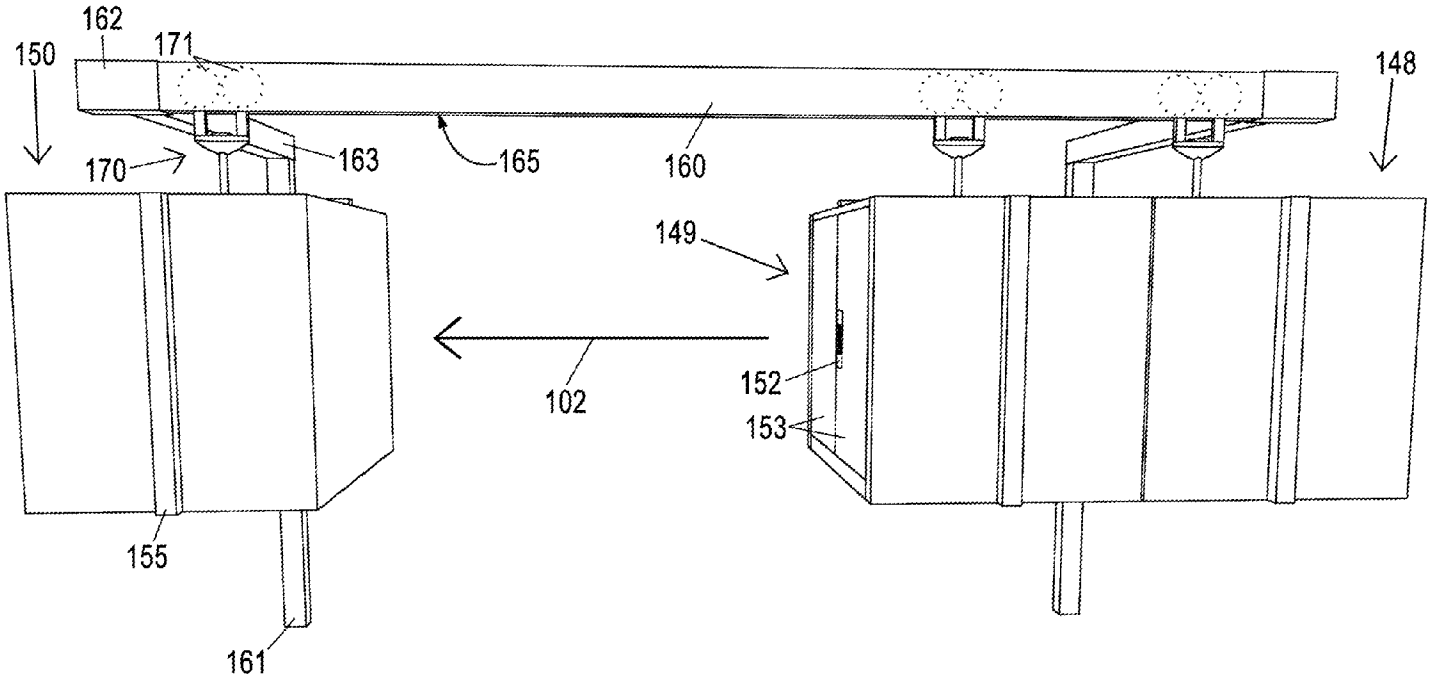
FIG. 1 illustrates a perspective view of an adjustable overhead storage cabinet system showing lateral cabinet motion.

FIG. 1 illustrates a perspective view of an adjustable overhead storage cabinet system showing linear cabinet motion along a beam. The adjustable overhead storage cabinet system comprises a set of wall mounts 161 (or wall brackets 161), support beams 163, a main beam 160, and a plurality of storage cabinets 148-150. The wall mounts 161 (left and right wall mounts) can be bolted or screwed into a wall or other suitable vertical structure, and connect to the support beams 163 to bear the weight of the main beam 160 and storage cabinets 148-150. The bottom surface of the main beam 160 contains an opening or channel 165 along its length. The main beam meets and is connected to the support beams via beam brackets 162. The beam bracket 162 serves as a stopper that prevents further motion of the rolling mechanism (and thus the corresponding storage cabinet) by blocking the channel 165 within the main beam. The bream bracket 162 can be removed to access the free end of the main beam in order to add or removed storage cabinets as desired.

The resulting structural framework provides ample weight-bearing capability, for a sturdy overhead system. The main beam 160 is configured to reversibly receive the cabinets via a rolling mechanism 170 that engages with an inner rail within the main beam 165 and moves within the channel 165. Extending from the top surface of each cabinet, the rolling mechanism 170 further comprises rail wheels 171, which sit inside of the main beam 160 (on a set of inner rails shown in FIG. 6) and are thus shown with dotted lines in FIG. 1. The storage cabinets 148-150 further comprise a sliding handle 155, doors 153, and a door handle 152. The door handle 152 is used to open the doors 153 and access the inside of the storage cabinet, while the sliding handle 155 is used to push/pull/rotate the storage cabinet into a desired position. In a nested state, the frontal and/or rear portions of each cabinet make contact with the adjacent cabinets, thereby obscuring the frontal portion of certain cabinets from view (cabinets 148 and 149 exhibit this nesting position in FIG. 1).

The nested state saves space, whereby unused cabinets are easily stacked or stowable. For purposes of accessing cabinet contents, each storage cabinet can be moved along the main beam via the rolling mechanism 170 and its wheels 171, which react to a force placed upon the cabinet along the beam by rolling back and forth along the main beam 160, in a direction parallel to the wall, and perpendicular to the support beams 163. Motion arrow 102 indicates said cabinet movement, here with respect to storage cabinet 150. As shown and described in connection with FIG. 3, access and positioning of the storage cabinets is also facilitated and enhanced by the rotation of the storage cabinets about their vertical axis (i.e. rotation in the horizontal plane). The ability of the cabinets to move in relation to one another allows a user to access the contents of each cabinet via the doors 153 found on the frontal portion of each cabinet. With this configuration, larger cabinets may be utilized that are not only more easily accessible than with traditional designs, but also allow more cabinets to be used in the system, because nesting the cabinets together substantially reduces the amount of space they occupy along the main beam 160.

Figure 2:
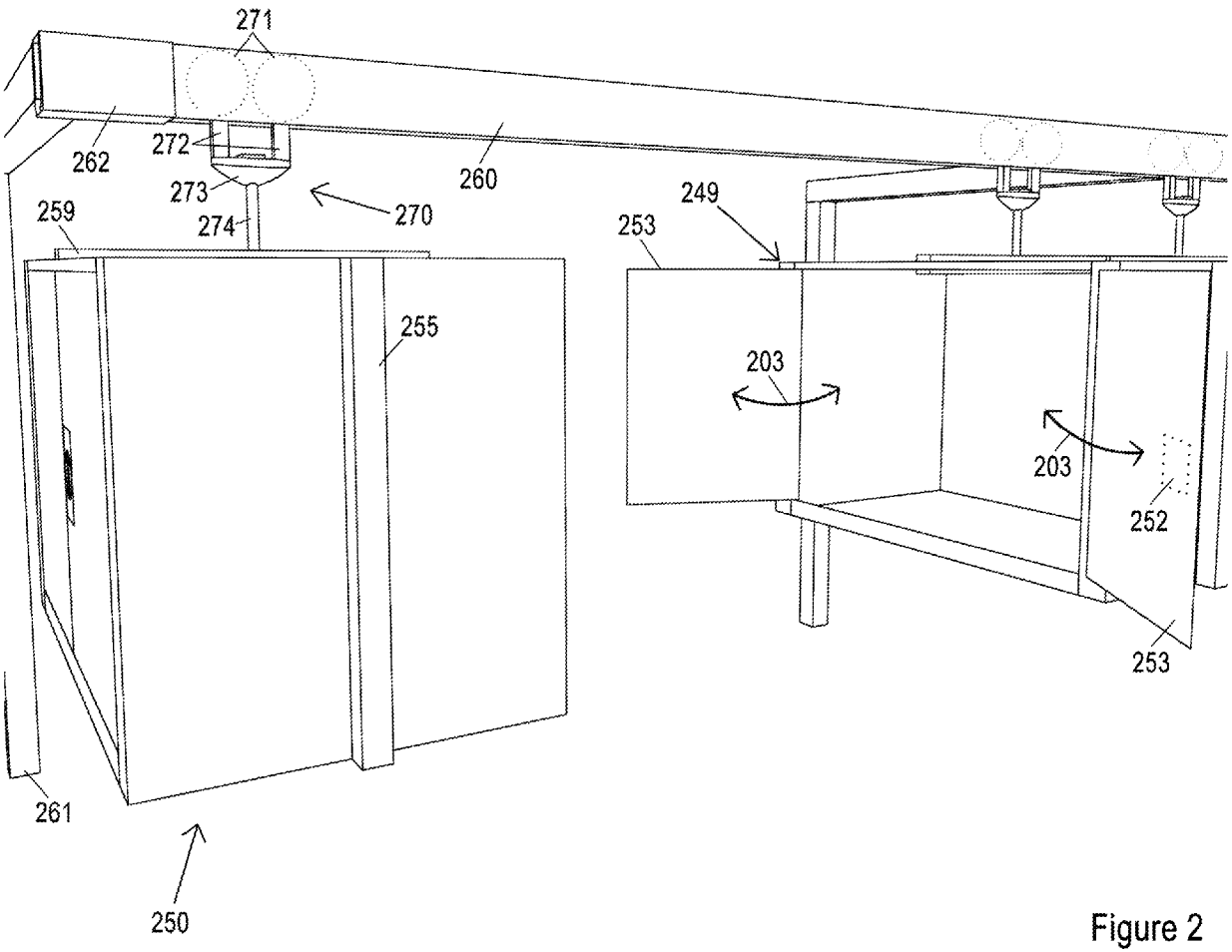
FIG. 2 illustrates a perspective view of the adjustable overhead storage cabinet system with the doors of a middle storage cabinet opened.
Figure 3:
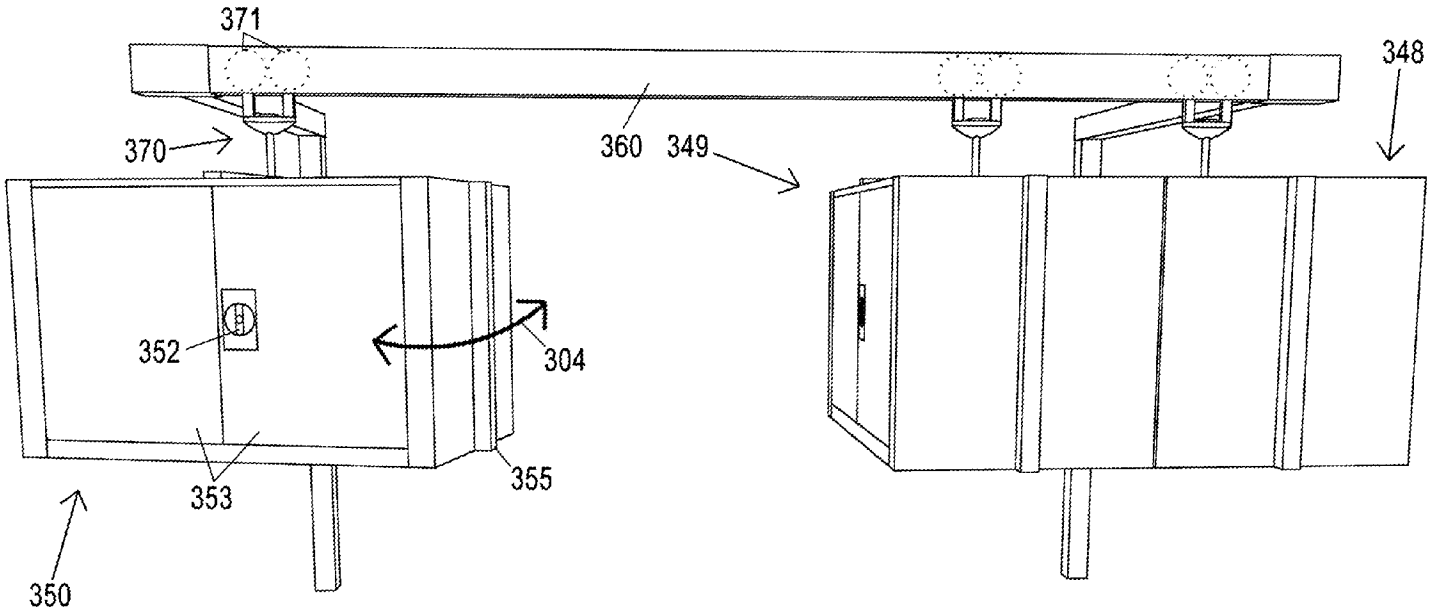
FIG. 3 illustrates a perspective view of the adjustable overhead storage cabinet system showing the rotation of the storage cabinets.

FIG. 2 illustrates a perspective view of the opening of the doors on storage cabinet 249. A user may access the interior space of a storage cabinet 249 by grasping the cabinet's door handle 252 and pulling the doors 253 open as indicated by the curved motion arrows 203. After accessing the interior space of a storage cabinet, a user may close off that space once again by closing the doors. Once this action is completed, a user is free to nest or stack the storage cabinets together using the sliding handles 255 to move one or more of the storage cabinets along the main beam 260. The rolling mechanism 270 comprises a lower portion 274, upper portion 272, and a swivel joint 273. The lower portion of the rolling mechanism 274 is connected with the storage cabinet 250 via a suspension brace 259. The rolling mechanism's upper portion 272 is rigidly connected with the rail wheels 271. The lower portion of the rolling mechanism is rotatably connected (i.e. it rotates in relation to the fixed upper portion) via the swivel joint 273, which thereby allows the storage cabinets to rotate about the vertical axis (i.e. in the horizontal plane) as shown in FIG. 3. At each end of the main beam 260, a rail bracket 262 is attached in order to connect the main beam 260 to the wall mounts 261. The wall mounts 261 are connected (i.e. bolted or screwed) to the wall, preferably the wall studs or other suitable structure. The beam brackets 262 provide structural support for the beam framework and also prevent the rolling mechanisms 270 from sliding out of the main beam 260. The ability to stack or nest the cabinets together allows for more efficient use of space because more cabinets can be fit in a space when they are stacked front-to-back instead of side-by-side as with conventional cabinets. Because cabinets are typically wider than they are deep, this system provides the best of both worlds whereby the cabinets are nested in what would conventionally be a sideways position when not in use, but can then be rotated to a front-facing position or accessed in the sideways position by sliding the adjacent cabinet to provide space.

FIG. 3 illustrates a perspective view of the adjustable storage system showing the rotation of the storage cabinet 350 about the vertical axis as indicated by the curved motion arrow 304. As described above, the rolling mechanism 370 contains a swivel joint (i.e. swivel joint 273 of FIG. 2) that allows the lower portion of the rolling mechanism 370 to rotate about the swivel joint. This allows the storage cabinets 348-350 to be rotated about their vertical axis to provide easier and more versatile access to the cabinets. The rotation of the storage cabinets (e.g. storage cabinet 350) is advantageous because in a nested position, access to the handle 352 and doors 353 may be somewhat hampered by objects stored beneath the cabinets. In congruence with the system's space-saving nature, the rotational aspect assures easy access to the overhead cabinets from a position outside the perimeter of the entire storage system, and thus, away from items on the floor that might sit beneath the storage system. For additional reasons, opening the doors and accessing the cabinet may be difficult when the user is not facing the front side of the cabinet. Thus, the ability to rotate the storage cabinets 90 degrees to face the user makes access easier and in some cases may eliminate the need to adjust the position(s) of one or more storage cabinets in order to have easy access. Conversely, conventional cabinets are effectively fixed to the floor and cannot be moved or rotated without great effort if at all. As a result, the dimensions and space occupied by conventional cabinets is effectively fixed, which limits the use of the available space. The present invention, however, provides space efficiency and convenience by providing storage cabinets that are overhead, movable, and rotatable. The rotatable components do not affect rotationally static components above the cabinet, including the rolling mechanism's wheels 371, main beam 360, etc. As with cabinet sliding, cabinet rotation may be aided by grasping the sliding handle 355. The rolling mechanism 370 can include a rotation lock mechanism to prevent unwanted rotation (based on user preference), although nesting the cabinets together substantially eliminates any unwanted rotation.

Figure 4:
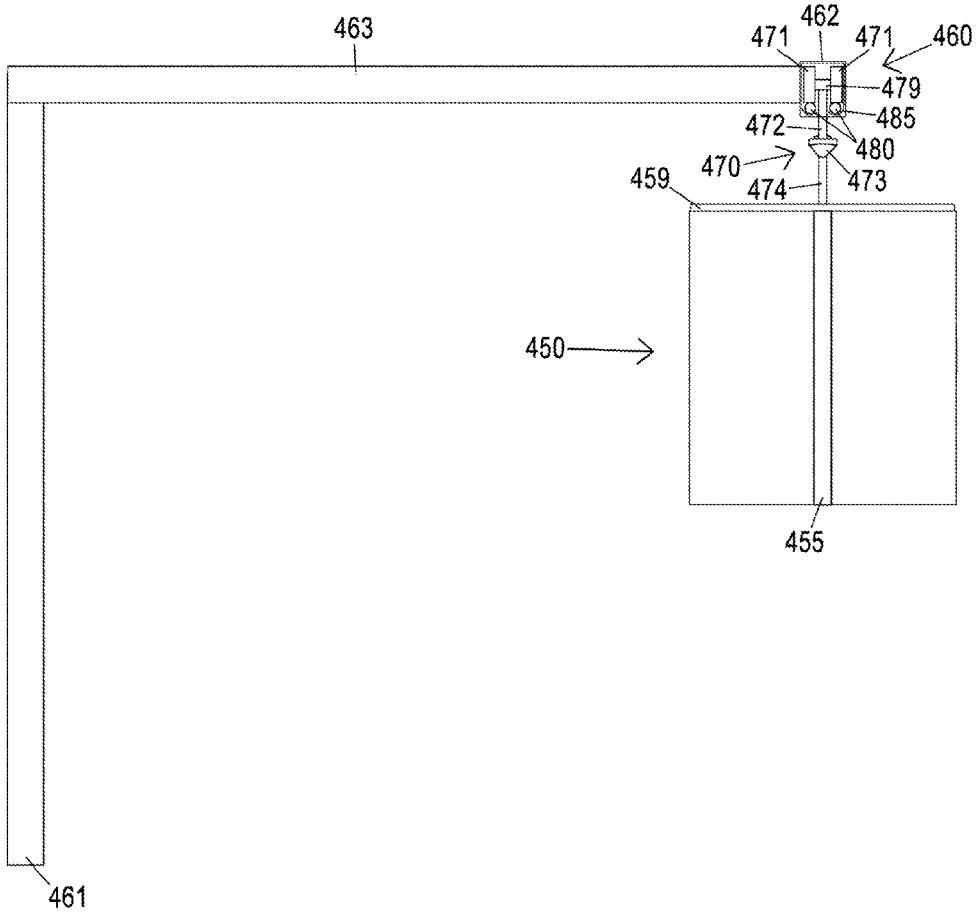
FIG. 4 illustrates a side view of the adjustable overhead storage cabinet system.

FIG. 4 illustrates a side view of the adjustable overhead storage cabinet system. This profile of the system shows the left wall mount 461, left support beam 463, the interior of the main beam 460, and storage cabinet 450 with sliding handle 455, suspension brace 459, and rolling mechanism 470. The rolling mechanism 470 is connected to the cabinet 450 via suspension brace 459, and has a lower portion 474 that extends upward from it. The lower portion 474 terminates in the swivel joint 473, which connects to the upper portion 472. The dual supporting upper portion 472 extends upward into the interior of the main beam 460 and connects therein to a set of fixed wheel axles 479, which connect to a plurality of wheels 471. Each wheel axle is flanked by a pair of wheels 471. The dual supporting nature of both the upper portion 472 and the wheel axles 479 provides for stable cabinet operation during sliding motions. This system prevents unwanted "teetering" of the cabinets in the direction of their lateral motion. Within the main beam 460, inner rail 485 is attached to rail cylinders 480 (in FIG. 1, these elements would run nearly the entire length of the main beam 160), which are the points of contact for the wheels 471. The cross-sectional shape of the inner rail 485 and rail cylinders 480 is exemplary, and these structures can have rectangular cross-sections. Moreover, inner rail 485 and rail cylinders 480 could be replaced by a single structure, such as by forming the bottom of the main beam 460 to provide a rectangular rail structure. During cabinet sliding, the weight of the cabinet is placed upon these rail cylinders 480 via the wheels 471, which travel along the cylinders for nearly the entire length of the main beam 460. Again, this end-to-end motion is flanked by a set of beam brackets 462 which prevent wheel motion beyond the interior edges of the main beam 460.

Figure 5:
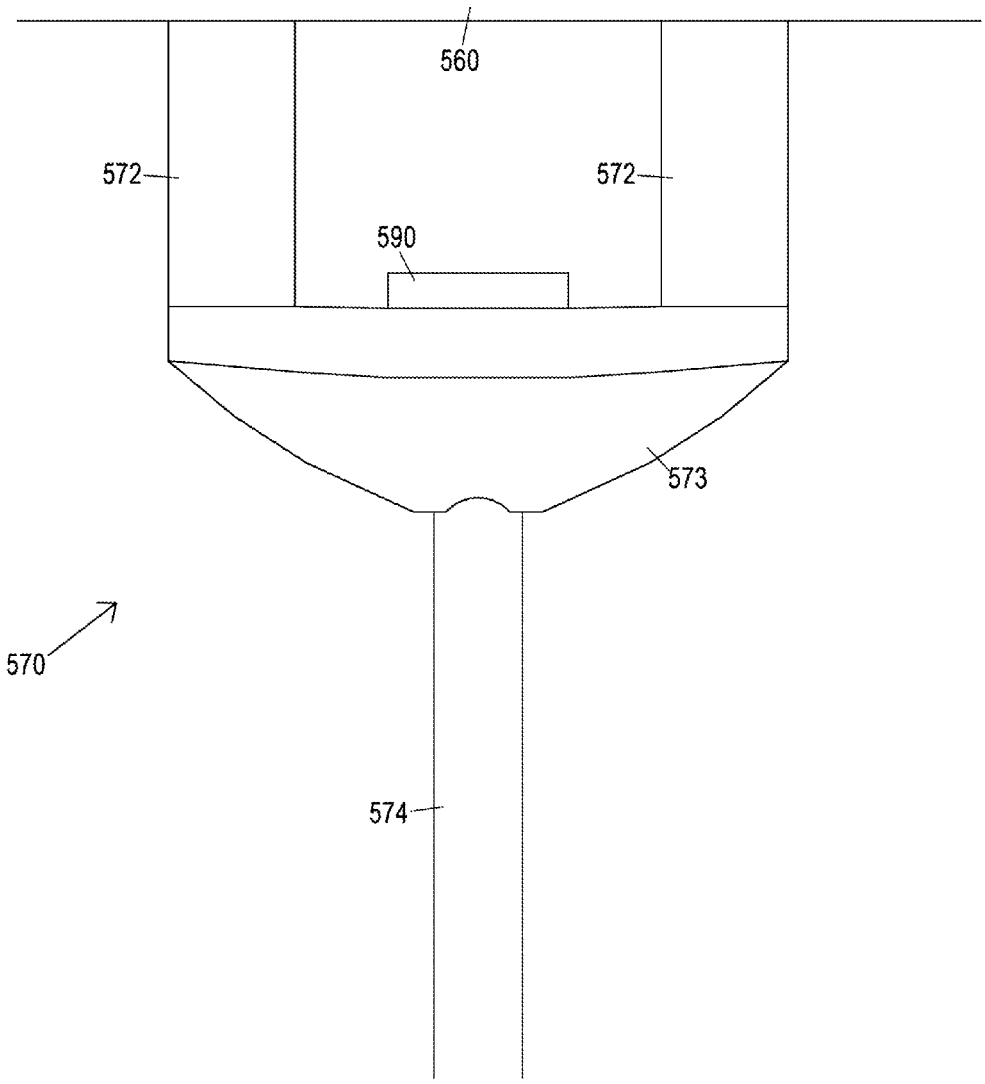
FIG. 5 illustrates a close-up front view of the storage cabinet rolling mechanism.

FIG. 5 illustrates a close-up front view of the rolling mechanism. The rolling mechanism 570 comprises a lower portion 574, an upper portion 572, and a swivel joint 573 with swivel nut 590, and sits within the main beam 560 via attached wheels. Rotational cabinet movement correlates to rotation of the rolling mechanism's lower portion 574, which is statically affixed to the cabinet. Rotation of the swivel nut 590 follows the rotation of the lower portion 574, via the swiveling afforded by the swivel joint 573. These rotational movements are contrary to the static position of swivel joint 573 which is fixed to upper portion 572. Thus, by applying a rotational force upon the cabinet, a user can control its axial position without disturbing components above it.

Figure 6:
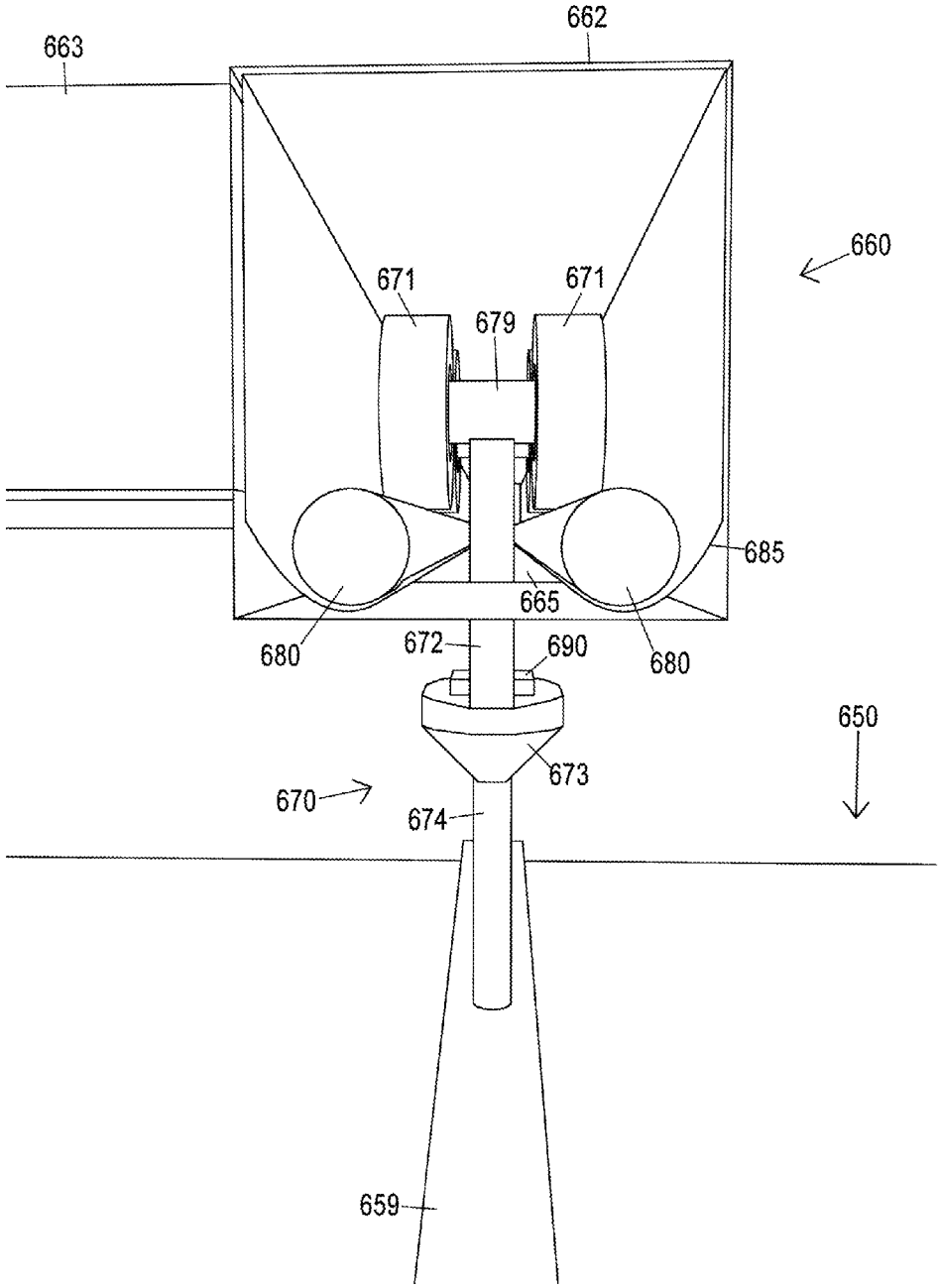
FIG. 6 illustrates a close-up view of the main beam interior with components integral to cabinet motion.

FIG. 6 illustrates a close-up, side view of the main beam interior with the components integral to cabinet motion. The rolling mechanism 670, comprising a lower portion 674, upper portion 672, swivel joint 673, and swivel nut 690, extends upward from the suspension brace 659 of the cabinet 650, entering the main beam 660 via a channel 665 on its lower surface. Here, the upper portion 672 meets with a pair of wheel axles 679, to which the wheels 671 are rotatably connected. Making contact with the rail cylinders 680, the wheels 671 allow for the back and forth rolling motion of the rolling mechanism 670, and hence the cabinet 650, along nearly the entire length of the main beam 660. The rail cylinders sit upon the inner rail 685, which is attached to the main beam itself, and runs along the length of its interior. Since the main beam is flanked on both ends by beam brackets 662, the rolling mechanism 670 is prevented from rolling out from the ends of the rail. Additionally, the beam brackets 662 connect the main beam 660 to the support beams 663.

Figure 7:
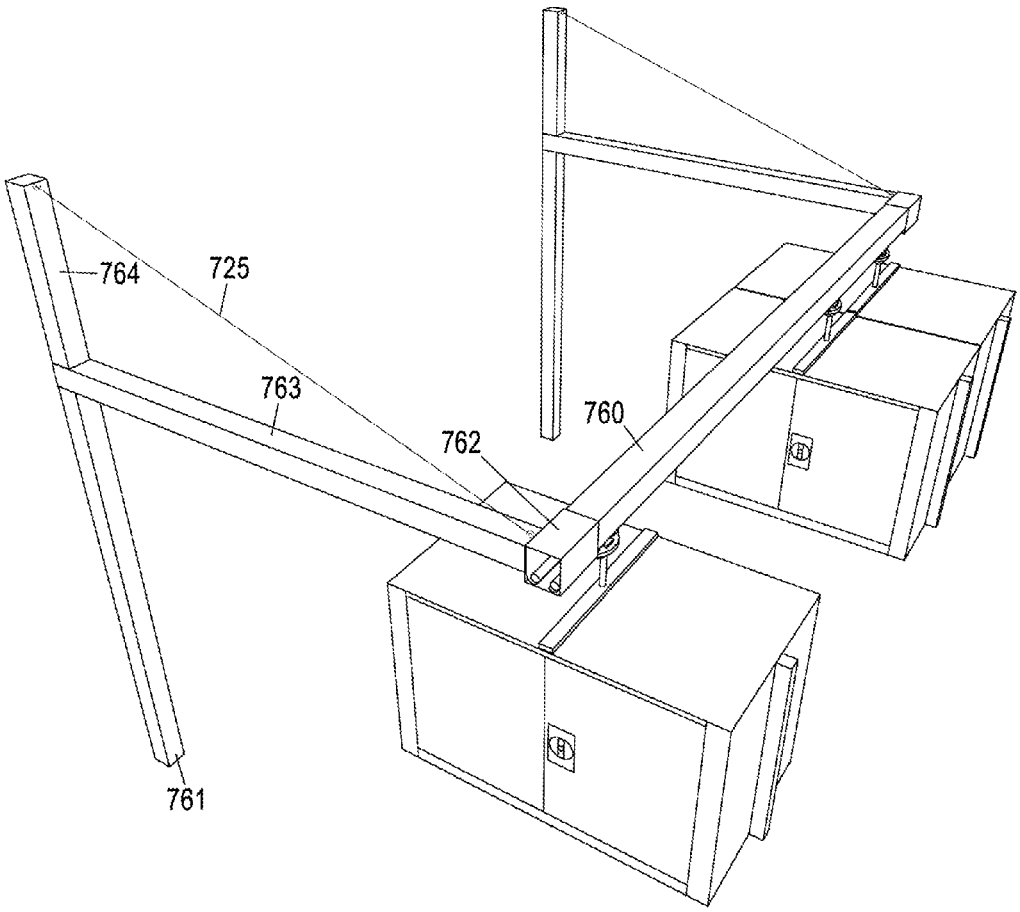
FIG. 7 illustrates a perspective view of the adjustable overhead storage cabinet system with extended wall mounts for additional support.

FIG. 7 illustrates a perspective view of the adjustable overhead storage cabinet system with enhanced wall mounts for additional support. As shown in previous figures, a wall-mounted structure provides a stable frame for sliding cabinets. The strength and reliability of the wall mounts 761 can be augmented by an additional wall-mount segment, i.e. upward mount 764. This component extends the upward reach of the wall mount 761, thereby increasing its weight-bearing capacity and reinforcing the integrity of the system as a whole. As shown, upward mount 764 and downward mount 761 meet at their respective proximal ends where they also connect with the support beam 763, and each terminate at a terminal end. Similarly, support beam 763 has a proximal end that meet with the wall and connects with the upward mount 764 and downward mount 761, and has a terminal end that connects with main beam 760 via beam bracket 762. The support beams 763 extend away from the wall in a direction perpendicular to both wall mounting components; the origin of this extension lies at the meeting point of the wall mount 761 and upward mount 764. Each support beam 763 meets with the main beam 760 at beam brackets 762. The uniting of wall mount 761 and upward mount 764 may be modular or singular in nature. The former method would require bolts, joining components, etc. to unite the two mounts, while the latter method would require no assembly. A singular structure would provide a single pair of wall mounts 761 which extend above their connected support beams 763 in a direction perpendicular to them. A suspension member 725 extends from the terminal end of upward mount 764 and connects upward mount 764 with the terminal end of support beams 763. Suspension member 725 can be a tensioned cable as shown in FIG. 7, or a rigid support member (e.g. rod or beam). Together, upward mount 764 and suspension member 725 provide enhance the support and stability of the structure.

Figure 8:
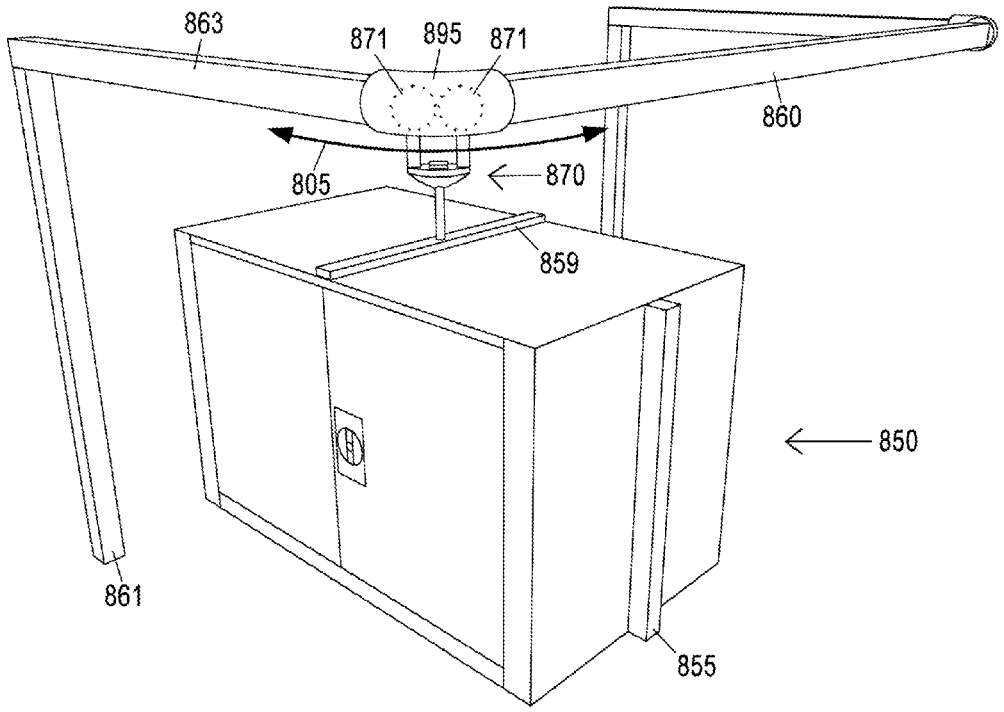
FIG. 8 illustrates an alternate embodiment of the adjustable overhead storage cabinet system having additional mobility along the support beams.
Figure 9:
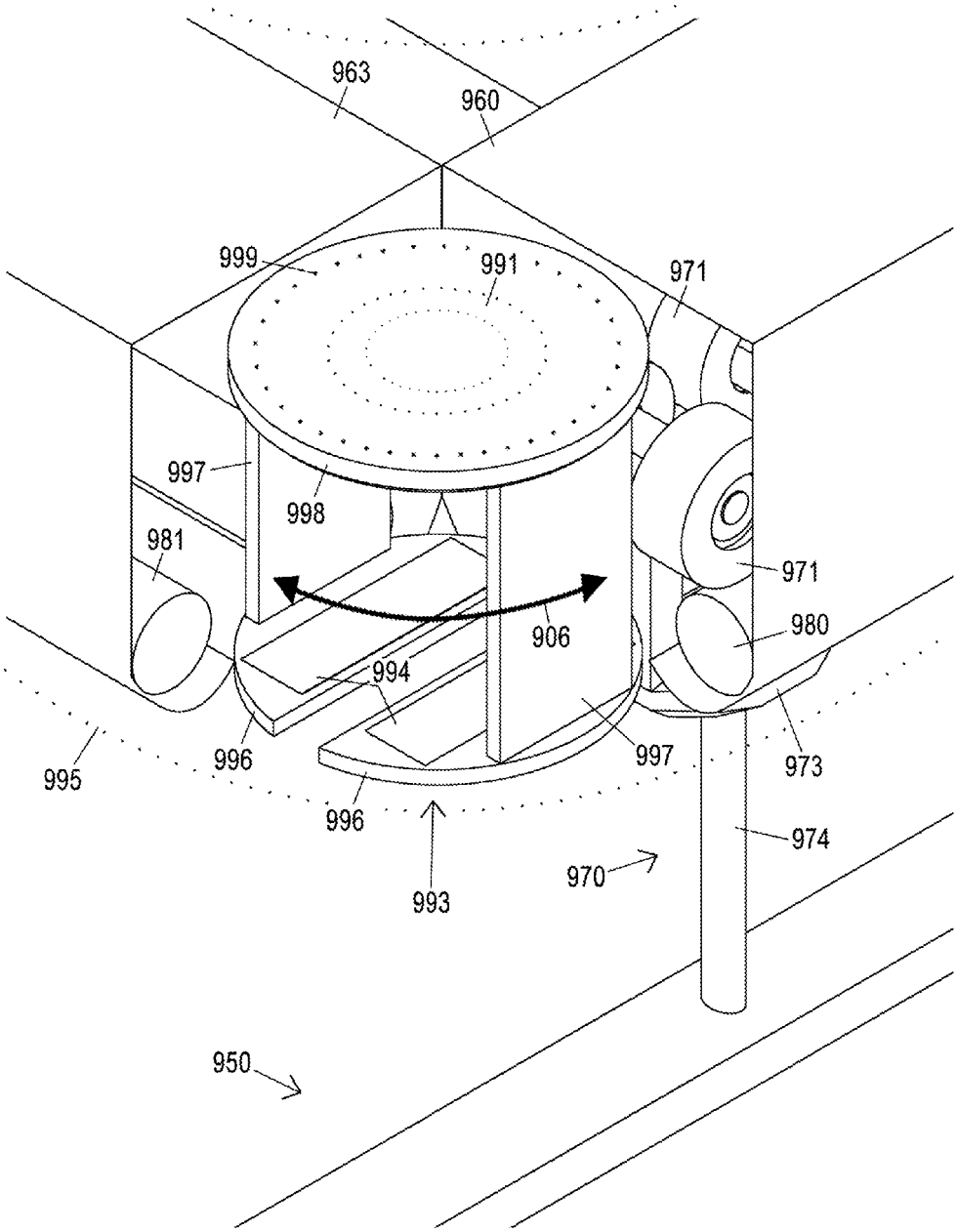
FIG. 9 illustrates an alternate embodiment of the adjustable overhead storage cabinet system showing a perspective view of the elbow joint's interior components.
Figure 10:
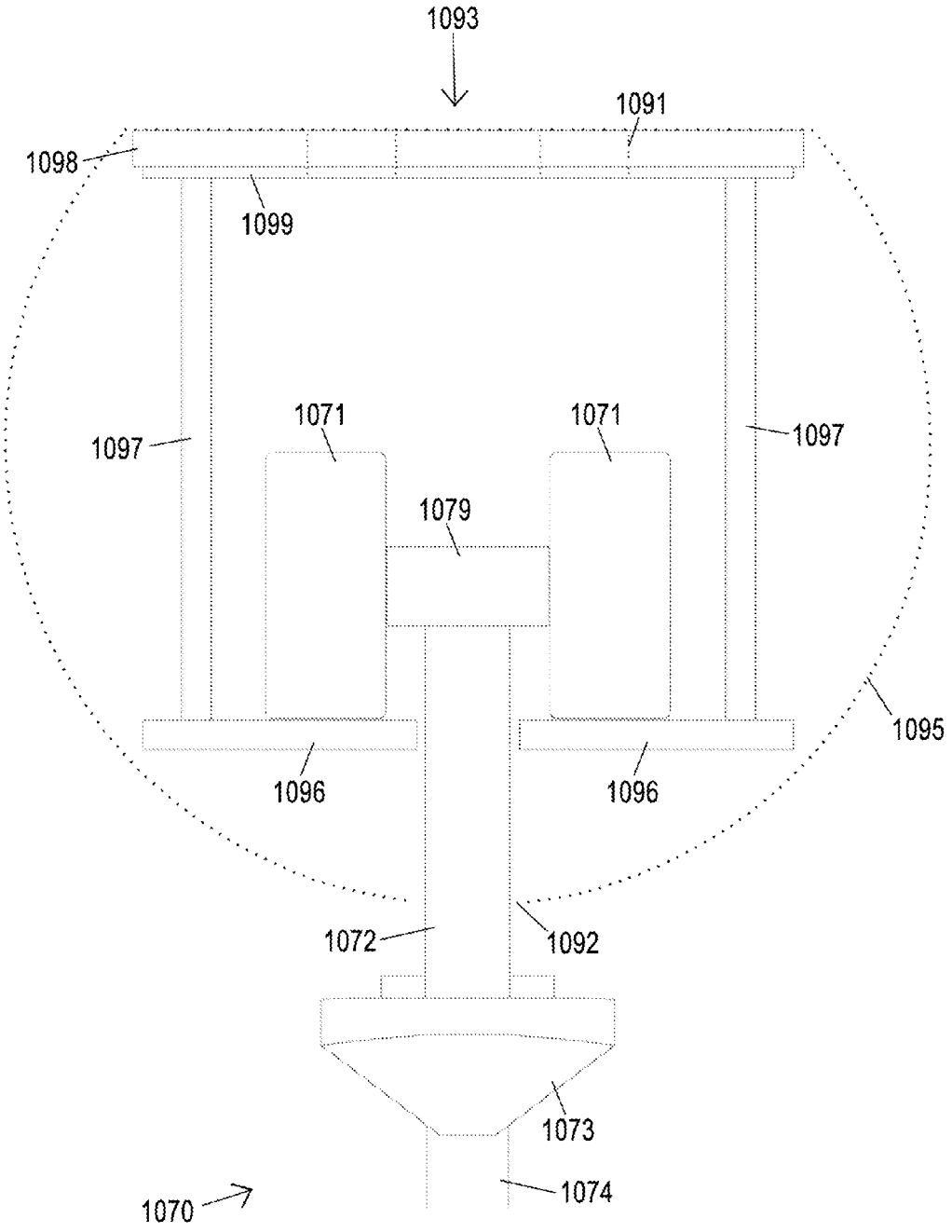
FIG. 10 illustrates an alternate embodiment of the adjustable overhead storage cabinet system showing an in-line view of the elbow joint's interior components.

FIGS. 8-10 illustrate an alternate embodiment of the adjustable overhead storage cabinet system that allows for additional cabinet motion along the support beams via a transitional component (i.e. elbow joint) that is placed between, and connects, the support beams and main beam. Obviously, in this embodiment, the support beams and elbow joint must also have a channel on their lower surface that is similar to, and in line with, the channel in the main beam (e.g. channel 165 in main beam 160 as described in FIG. 1). As shown in FIG. 8, the adjustable overhead storage cabinet includes wall mounts 861, support beams 863, and main beam 860. Instead of an angular, bolt-only point of connection between the support beams and main beam, this alternate method employs an elbow joint 895 that allows the storage cabinets to travel through the corner as described below. This elbow joint effectively connects not only the main beam itself, but also any interior rail components (integral to cabinet motion) with the support beams. The bottom surface of the elbow joint 895 contains a channel that is inline with, and connects with, the channels in the support beam and main beam. The result is a continuous, curved interior rail running the lengths of both the main beam and support beams. Structurally, the elbow joint 895 functions like the beam bracket (e.g. beam bracket 262 of FIG. 2) except that it features additional components that provide the functionality of allowing the rolling mechanism to pass through the corner. With this configuration, a cabinet 850, with sliding handle 855, suspension brace 859, and rolling mechanism 870, may be slid along both the lengths of the main beam 860 and the support beams 863, with its wheels 871 traveling through the elbow joint 895 to move between the main beam and support beams. This transitional motion is indicated by motion arrow 805. This configuration provides additional versatility and space-efficiency by allowing the storage cabinets to be moved into additional locations (i.e. closer to the wall). This provides enhanced versatility to the existing cabinets, and allows for additional cabinets to be added or larger cabinets to be utilized. This capability is particularly advantageous where the user needs to access or use space below the cabinets and desires to re-position the storage cabinets.

FIG. 9 illustrates an alternate embodiment of the adjustable overhead storage cabinet system showing a perspective view of the elbow joint's interior components. For ease of viewing, the exterior surface of the elbow joint 995 is shown with dotted lines. Attached to its interior top surface (i.e. the ceiling of the corner of the elbow joint), a suspended swivel assembly 993 provides the functionality necessary to bridge the gap between the rails 980 of the main beam 960 and the beam cylinders 981 of the support beams 963 for continuous cabinet motion. The rotatable swivel assembly 993 comprises a fixed top plate 998, vertical support members 997, and a pair of semicircular wheel platforms 996, each with a wheel groove 994. As with other elements in the present invention, the semicircular shape of the wheel platforms 996 is merely exemplary, and the wheel platforms may take on other shapes (e.g. rectangular) while keep with the spirit of the invention. The support walls 997 connect perpendicularly to the fixed top plate 998 and wheel platforms 996. The fixed top plate 998 is affixed to the ceiling of the elbow joint. Below the fixed top plate 998 is a rotating top plate 999 via the swivel hardware 991 that is connected with the remainder of the swivel assembly such that the entire swivel assembly 993 rotates with respect to the fixed top plate 998. The swivel hardware can comprise traditional rotational components such as a ball bearing ring. Hence, top plate 998 is the only part of the swivel assembly 993 that does not rotate. The design of the swivel assembly 993 is highly specialized because it must be configured such that it can (1) receive the rolling mechanism's wheels (and axles) while maintaining a channel to accommodate the lower portion 974, and (2) rotate 90 degrees. Because the swivel assembly must maintain a channel and be able to rotate, it must be suspended from above and rotate from above. The suspended swivel assembly can be made of steel or other suitably strong and durable material.

The suspended swivel assembly is configured to receive the rolling mechanism of the storage cabinet, rotate 90 degrees, and then eject the rolling mechanism and associate storage cabinet. The rolling mechanism 970, with lower portion 974 and swivel joint 973, is configured to roll into the swivel assembly 993 as its associated sliding cabinet 950 is slid toward the terminal end of either the support beam 963 or main beam 960. As the rolling mechanism 970 enters the swivel assembly 993, the lower portion 974 passes through and rests in the gap between wheel platforms 996. Capable of 90-degree rotation, the swivel assembly 993 accepts the wheels 971 of the rolling mechanism 970 onto the wheel grooves of wheel platforms 996, thus occupying the open space between the support members 997. Simultaneously, as indicated by motion arrow 906, the swivel assembly 993 rotates 90 degrees, such that the opening between its support walls 997 now faces the opening of the terminal end of the support beam 963. As the cabinet 950 is continually slid along the elbow joint 995, the wheels 971 of the rolling mechanism 970 are forced to roll onto the beam cylinders 981 of support beam 963. Thus, as described, sliding of the cabinet may continue from the main beam 960 to the support beam 963, and vice versa.

FIG. 10 illustrates an alternate embodiment of the adjustable overhead storage cabinet system showing an in-line view of the elbow joint's interior components. The elbow joint 1095, shown with dotted lines, is statically connected to the swivel assembly 1093 via its fixed top plate 1098. Fixed top plate is rotatably connected to rotating top plate 1099 via swivel hardware 1091. Extending from the body of the fixed top plate via a ball bearing unit or similar rotationally capable structure, the rotating top plate 1099 permits 90 degrees of rotation for it and connected elements below. These elements include attached support walls 1097 and semicircular wheel platforms 1096. This rotational body of the swivel assembly 1093 accepts the cabinet's rolling mechanism 1070, with lower portion 1074, swivel joint 1073, upper portion 1072, wheel axles 1079, and wheels 1071. As the cabinet is slid along any of the rails and reaches the rail's open terminal face within an elbow joint 1095, its wheels can then land onto the platforms 1096 of the swivel assembly 1093, rotate along with the swivel assembly, then roll onto the adjacent rail (provided that the rolling mechanism experiences a continual force via cabinet sliding). It is important to note the open channel that exists on the lower portion of the elbow joint 1095. Elbow channel 1092 allows the upper portion 1072 of the rolling mechanism 1070 to comfortably transition into and through the elbow joint. Thus, the suspended swivel While there have been described herein what are considered to be preferred and exemplary embodiments of the present invention, other modifications of the invention shall be apparent to those skilled in the art from the teachings herein. It is noted that the embodiments disclosed are illustrative rather than limiting in nature and that a wide range of variations, modifications, changes, substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

What is claimed is:

1. An adjustable overhead storage system comprising:

a main beam having a lower surface with a channel and an inner rail, said channel and inner rail configured to reversibly receive and support one or more storage cabinets;

a pair of support beams, each of said support beams connected to an end of the main beam and configure to support the main beam;

a pair of mounting brackets, each of said mounting brackets connected to one of said support beams and configured to support the main beam and support beams;

a rolling mechanism corresponding to each of the one or more storage cabinets, said rolling mechanism comprising a swivel joint, a set of wheels, an upper portion connected with the main beam, and a lower portion connected with the storage cabinet;

wherein the swivel joint of the rolling mechanism allows the upper portion of the rolling mechanism to rotate with respect to the lower portion of the rolling mechanism and thereby allows the one or more storage cabinets to rotate about a vertical axis; and wherein the set of wheels of the rolling mechanism rest on top of the inner rail within the main beam and allow the one or more storage cabinets to move along the main beam.

2. The adjustable overhead storage system of claim 1 wherein each of said one or more storage cabinets has a pair of doors on a front side and a handle on an adjacent outer side.

3. The adjustable overhead storage system of claim 1 wherein each mounting bracket further comprises a support member that extends downward from the support beam and a support member that extends upward from the support beam.

4. The adjustable overhead storage system of claim 1 wherein each mounting bracket further comprises a support member that extends downward from the support beam, a support member that extends upward from the support beam, and a support member that extends from a terminal end of the upward support to a terminal end of the support beam.

5. An adjustable overhead storage system comprising:

a main beam having a lower surface with a channel and an inner rail, said channel and inner rail configured to reversibly receive and support one or more storage cabinets;

a pair of support beams, each of said support beams connected to an end of the main beam and configured to support the main beam, said support beams having a lower surface with a channel and an inner rail, said channel and inner rail configured to reversibly receive and support one or more storage cabinets;

an elbow joint that connects the main beam to the support beam, said elbow joint having a channel on a lower surface that is continuous with the channel of the main beam and the support beam, and a suspended swivel assembly housed within the corner of the elbow joint that is rotatably connected with the ceiling of the elbow joint;

a pair of mounting brackets, each of said mounting brackets connected to one of said support beams and configured to support the main beam and support beams;

a rolling mechanism corresponding to each of the one or more storage cabinets, said rolling mechanism comprising a swivel joint, a set of wheels, an upper portion connected with the main beam, and a lower portion connected with the storage cabinet;

wherein the swivel joint of the rolling mechanism allows the upper portion of the rolling mechanism to rotate with respect to the lower portion of the rolling mechanism and thereby allows the one or more storage cabinets to rotate about a vertical axis;

wherein the set of wheels of the rolling mechanism rest on top of the inner rail within the main beam and allow the one or more storage cabinets to move along the main beam; and wherein the swivel assembly is configured to receive and rotate the rolling mechanism to allow the movement of a storage cabinet from the main beam to the support beam, and from the support beam to the main beam.

6. The adjustable overhead storage system of claim 5 wherein each of said one or more storage cabinets has a pair of doors on a front side and a handle on an adjacent outer side.

7. The adjustable overhead storage system of claim 5 wherein the swivel assembly is suspended from a fixed platform that is rigidly attached to the ceiling of the elbow joint.

8. The adjustable overhead storage system of claim 5 wherein the swivel assembly further comprises two wheel platforms separated by a channel, an upper platform with a swivel joint at its center, and two vertical support members that connect each of the wheel platforms to the upper platform.

9. The adjustable overhead storage system of claim 8 wherein the swivel assembly is suspended from a fixed platform that is rigidly attached to the ceiling of the elbow joint, wherein the upper platform is rotatably connected with the fixed platform via the swivel joint.

10. The adjustable overhead storage system of claim 5 wherein the two vertical support members of the swivel assembly are each connected to an outer perimeter of the wheel platforms.

11. The adjustable overhead storage system of claim 5 wherein each mounting bracket further comprises a support member that extends downward from the support beam and a support member that extends upward from the support beam.

12. The adjustable overhead storage system of claim 5 wherein each mounting bracket further comprises a support member that extends downward from the support beam, a support member that extends upward from the support beam, and a support member that extends from a terminal end of the upward support to a terminal end of the support beam.

* * * * *